US005767806A

United States Patent [19]

Watanabe et al.

[11] Patent Number: 5,767,806

[45] Date of Patent: Jun. 16, 1998

[54] PHASED-ARRAY ANTENNA APPARATUS

[75] Inventors: Tsutomu Watanabe, Yokohama; Noriaki Miyano, Kawasaki, both of Japan

[73] Assignee: Kabushiki Kaisha Toshiba, Kawasaki, Japan

[21] Appl. No.: 747,075

[22] Filed: Nov. 8, 1996

[30] Foreign Application Priority Data

Nov. 16, 1995 [JP] Japan ..... 7-298366

[51] Int. Cl.[6] ..... H01Q 3/24

[52] U.S. Cl. ..... 342/373; 342/81; 342/372

[58] Field of Search ..... 342/81, 157, 372, 342/373

[56] References Cited

U.S. PATENT DOCUMENTS

| | | | |
|---|---|---|---|
| 4,134,113 | 1/1979 | Powell | 343/5 CM |
| 5,494,245 | 2/1996 | Chazelle et al. | 342/36 |
| 5,579,016 | 11/1996 | Wolcott et al. | 342/378 |
| 5,585,803 | 12/1996 | Miura et al. | 342/372 |

OTHER PUBLICATIONS

Hans Steyskal. "Digital Beam Forming At Rome Laboratory", The Rome Laboratory Technical Journal, (pp. 7–21), vol. I, No. I, Jun., 1995.

*Primary Examiner*—Thomas H. Tarcza
*Assistant Examiner*—Dao L. Phan
*Attorney, Agent, or Firm*—Oblon, Spivak, McClelland, Maier & Neustadt, P.C.

[57] ABSTRACT

In a phased-array antenna apparatus of this invention, one of the transmit/receive modules of each of radiators is set in a receiving operation state in accordance with a control signal from an arithmetic processing unit. An RF reference signal from an exciter is radiated in the air from a reference antenna and received by the transmit/receive modules in the receiving operation state. Thereafter, the signals are frequency-converted by the receiver, and element data are extracted from the signals by a beam forming section. The arithmetic processing unit detects the phase and amplitude data of the reception signals from the transmit/receive modules on the basis of the element data, and compares the detected data with the past phase and amplitude data of the transmit/receive modules, thereby calculating correction data and weight data for the transmit/receive modules.

16 Claims, 10 Drawing Sheets

PHASED-ARRAY ANTENNA APPARATUS

BACKGROUND OF THE INVENTION

1. Field of the Invention

The present invention relates to a phased-array antenna apparatus with a self-correction function which is used for a radar apparatus, a communication apparatus, or the like, and designed to automatically perform amplitude and phase corrections and fault diagnosis.

2. Description of the Related Art

An antenna apparatus used for a radar, communication, or the like is required to have a beam scanning function to observe a wide range at a high speed. As an apparatus having such a function, a phased-array antenna apparatus constituted by a plurality of transmit/receive modules arranged in an array is available. The phased-array antenna apparatus controls the passed phases of transmit/receive signals in the respective transmit/receive modules to allow a beam scanning operation while the antenna apparatus body is fixed.

Control of the passed phases in the above transmit/receive modules varies depending on the radio environment, changes in temperature in the antenna apparatus, and the like. For this reason, amplitude and phase corrections and fault diagnosis are periodically performed for each transmit/receive module. If each module has many elements, it takes much time and labor to perform the above checks and corrections. For this reason, the phased-array antenna apparatus has a self-correction function.

A conventional phased-array antenna apparatus with a self-correction function will be described below with reference to FIG. 12. Note that FIG. 12 shows only the reception system.

Radar echoes from the object to be observed are received by element antennas 1111 to 111M. The phases of the echoes or the amplitudes and phases of the echoes are controlled by corresponding transmit/receive modules 1121 to 112M. Note that these transmit/receive modules 1121 to 112M are controlled by a scan controller 500. The reception signals output from the transmit/receive modules 1121 to 112M are synthesized into an RF (analog) synthetic signal by an RF synthesizing circuit 1140. This signal is then input to a receiver 210.

The RF synthetic signal from the RF synthesizing circuit 1140 is subjected to frequency conversion in the receiver 210 with a local signal from an exciter 300 (to be described later). After this frequency conversion, the resultant signal undergoes I/Q orthogonal detection (or A/D conversion after phase detection) in a signal processing unit 110, thereby obtaining reception data.

Correction in the transmit/receive modules 1121 to 112M is performed on the basis of a control signal from an arithmetic processing circuit 410. First of all, the scan controller 500 turns on only a specific transmit/receive module to be corrected in advance. The RF reference signal generated from a local signal from the exciter 300 is input to a reference antenna 600.

The RF reference signal is then radiated from the reference antenna 600 toward the array of the element antennas 1111 to 111M. The RF reference signal radiated in the air is received by the element antennas 1111 to 111M. Only the signal having passed through the specific transmit/receive module is input to the receiver 210 through the RF synthesizing circuit 1140.

Similar to the above case of reception of the radar echoes from the object, the signal undergoes frequency conversion in the receiver 210. Reception data is then obtained from the resultant signal upon detection in the signal processing unit 110. The data is extracted at the timing of a timing signal from the arithmetic processing circuit 410 and input thereto.

The arithmetic processing circuit 410 detects the amplitude and phase of the reception signal from the specific transmit/receive module on the basis of the above data. The arithmetic processing circuit 410 then compares the detected amplitude and phase with those of data in the specific transmit/receive module at the start of the operation to calculate the phase correction amounts or the amplitude and phase correction amounts required for adjustment.

The above operation is sequentially repeated to calculate the above correction amounts for all the elements. Thereafter, wavefront correction is performed for each antenna through the scan controller 500 on the basis of these correction amounts. When fault diagnosis of each transmit/receive module is to be performed, the amplitude and phase are obtained from reception data and compared with the amplitude and phase values at the start of the operation to perform fault determination in the same manner as described above.

In the conventional phased-array antenna apparatus having the above arrangement, however, since calculation of correction amounts and fault diagnosis are sequentially performed in units of elements, it takes much time to perform the above detection for all the elements especially when each antenna has many elements.

SUMMARY OF THE INVENTION

It is an object of the present invention to provide a phased-array antenna apparatus which can detect the amplitudes and phases of a plurality of reception signals within a short period of time.

It is another object of the present invention to provide a phased-array antenna apparatus which can perform correction of the antenna wavefront and fault diagnosis for elements.

In order to achieve the above objects, according to the present invention, there is provided a phased-array antenna apparatus comprising a plurality of radiators each including a plurality of element antennas arranged in an array, a plurality of transmit/receive modules for transmitting/receiving RF signals to/from the corresponding element antennas and controlling phases and amplitudes of the RF signals on the basis of a control signal, and an RF synthesizing circuit for synthesizing reception signals output from the plurality of transmit/receive modules, and outputting the resultant signal as an RF synthetic signal, scan control means for generating a control signal for controlling phases and amplitudes of the plurality of transmit/receive modules for each of the plurality of radiators, frequency conversion means for separately frequency-converting the RF synthetic signals output from the plurality of radiators, and outputting the resultant signals as reception IF signals, analog/digital conversion means for separately converting the plurality of reception IF signals output from the frequency conversion means into digital signals, and outputting the signals as element signals, beam forming means for performing beam formation by separately weighting the plurality of element signals output from the analog/digital conversion means in accordance with external weight data and adding the signals, and outputting the addition results as reception data, element signal extraction means for extracting data from the plurality of element signals output from the analog/digital conversion means at the same timing, and arithmetic processing means for detecting amplitudes and phases of the RF synthetic signals, output from the plurality of radiators, from the data extracted by the element signal extraction means.

In the phased-array antenna apparatus having the above arrangement, for example, the transmit/receive modules of each radiator are operated one by one to receive an RF reference signal. With this operation, reception signals from the operated transmit/receive modules are output as RF synthetic signals to be output from the respective radiators. The amplitudes and phases of the reception signals output from the operated transmit/receive modules are detected altogether from the data based on the RF synthetic signals.

According to the phased-array antenna apparatus having the above arrangement, therefore, the amplitudes and phases of the output signals from the transmit/receive modules equal in number to the radiators can be detected at the same time.

In addition, according to the present invention, the apparatus further comprises oscillation means for generating a local signal used for frequency conversion in the frequency conversion means and an RF reference signal based on the local signal, and a reference antenna for transmitting the RF reference signal to the radiators.

According to this arrangement, since the apparatus has the reference antenna for transmitting RF reference signals toward the radiators, the amplitudes and phases of output signals from a plurality of transmit/receive modules can be detected by using identical RF reference signals.

In addition, in the present invention, the arithmetic processing means has a function of sequentially performing control, with respect to all the transmit/receive modules, to operate only some of the transmit/receive modules of the plurality of radiators.

According to this arrangement, since an operation of detecting the amplitudes and phases of output signals from transmit/receive modules equal in number to the radiators is repeated, the amplitudes and phases of output signals from all the transmit/receive modules can be detected within a short period of time.

In addition, in the present invention, the arithmetic processing means has a detection function of detecting amplitudes and phases of reception signals output from the operated transmit/receive modules on the basis of the data extracted by the element signal extraction means, a calculation function of calculating variation amounts of amplitudes and phases of the reception signals by comparing the detection results obtained by the detection function with past detection results associated with the operated transmit/receive modules, and a function of controlling the phase shift amounts of the corresponding transmit/receive modules or the phase shift amounts and gains thereof, through the scan control means on the basis of the variation amounts obtained by the calculation function.

According to this arrangement, the amplitudes and phases of reception signals output from all the transmit/receive modules are detected within a short period of time. The detection results are compared with the previous detection results to obtain variation amounts. The phase shift amounts of the corresponding transmit/receive modules or the phase shift amounts and gains thereof are controlled through the scan control means on the basis of the variation amounts. Therefore, errors caused in the transmit/receive modules can be calibrated, and the antenna wavefront can be corrected within a short period of time.

In addition, in the present invention, the arithmetic processing means has a detection function of detecting amplitudes and phases of reception signals output from the operated transmit/receive modules on the basis of the data extracted by the element signal extraction means, a calculation function of calculating variation amounts of amplitudes and phases of the reception signals by comparing the detection results obtained by the detection function with past detection results associated with the operated transmit/receive modules, and a function of calculating the weight data on the basis of the variation amounts obtained by the calculation function, and controlling weighting of the beam forming means.

According to this arrangement, the amplitudes and phases of reception signals output from all the transmit/receive modules are detected within a short period of time. The detection results are compared with the previous detection results to obtain variation amounts. The weight data based on the variation amounts calculated to control weighting of the beam forming means. Therefore, amplitude and phase errors caused in reception signals before the signals are input to the beam forming means can be corrected by the above weighting to perform beam formation within a short period of time.

In addition, in the present invention, the arithmetic processing means has a detection function of detecting amplitudes and phases of reception signals output from the operated transmit/receive modules on the basis of the data extracted by the element signal extraction means, a calculation function of calculating variation amounts of amplitudes and phases of the reception signals by comparing the detection results obtained by the detection function with past detection results associated with the operated transmit/receive modules, and a function of detecting the transmit/receive modules as faulty elements when the variation amounts obtained by the calculation function exceed predetermined values.

According to this arrangement, the amplitudes and phases of reception signals output from all the transmit/receive modules are detected within a short period of time. The detection results are compared with the previous detection results to obtain variation amounts. When the variation amounts exceed predetermined values, the transmit/receive modules corresponding to the variation amounts are detected as faulty elements. Therefore, fault diagnosis of all the transmit/receive modules can be performed within a short period of time.

In addition, in the present invention, the arithmetic processing means has a function of operating some of the plurality of transmit/receive modules through the scan control means, a detection function of detecting amplitudes and phases of reception signals output from the operated transmit/receive modules from the data extracted by the element signal extraction means, a calculation function of calculating variation amounts of amplitudes and phases of the reception signals by comparing the detection results obtained by the detection function with past detection results associated with the operated transmit/receive modules, and a function of calculating a distribution state of continuous variation amounts on an antenna aperture formed by the plurality of element antennas, arranged in an array, on the basis of the variation amounts obtained by the calculation function.

According to this arrangement, some of the plurality of transmit/receive modules are operated, and the amplitudes and phases of reception signals output from the operated transmit/receive modules are detected. The detection results are compared with the previous detection results to obtain variation amounts. The distribution state of continuous variation amounts on the antenna aperture formed by the plurality of element antennas arranged in an array is calculated on the basis of the variation amounts.

Since the variation amounts in all the transmit/receive modules can be obtained without detecting the variation amounts in all the transmit/receive modules, the time required to detect the above variation amounts can be shortened.

In addition, in the present invention, the arithmetic processing means has a function of controlling phase shift amounts and gains of the transmit/receive modules through the scan control means on the basis of the calculation results obtained by the calculation function of calculating the distribution state of continuous variation amounts on the antenna aperture.

According to this arrangement, since the phase shift amounts and gains of the respective transmit/receive modules are controlled on the basis of the calculation result of the distribution state of variation amounts, all the transmit/receive modules can be calibrated, and correction of the antenna wavefront can be completed within a short period of time.

In addition, in the present invention, the arithmetic processing means has a function of calculating the weight data based on the calculation results obtained by the calculation function of calculating the distribution state of continuous variation amounts on the antenna aperture, and controlling weighting of the beam forming means.

According to this arrangement, weight data are calculated on the basis of the calculation result of the distribution state of variation amounts, and weighting of the beam forming means is controlled. Therefore, amplitude and phase errors caused in reception signals before the signals are input to the beam forming means are corrected by the above weighting within a short period of time, thus performing beam formation.

In addition, according to the present invention, there is provided a phased-array antenna apparatus comprising transmit/receive means for controlling phases and amplitudes of a plurality of signals, and transmitting/receiving the controlled signals, oscillation means for generating a local signal and an RF pilot signal based on the local signal, frequency conversion means having a distribution function of distributing the RF pilot signal into a plurality of routes, a selection function of selecting the plurality of RF pilot signals distributed by the distribution function or a plurality of signals received by the transmit/receive means, and a plurality of frequency conversion functions of frequency-converting the plurality of signals selected by the selection function by using the local signal, and outputting the resultant signals as reception IF signals, analog/digital conversion means for separately converting the plurality of reception IF signals output from the frequency conversion means into digital signals, and outputting the digital signals as element signals, beam forming means for separately performing weighting of the plurality of element signals output from the analog/digital conversion means in accordance with external weight data, then adding the signals to perform beam formation, and outputting the resultant data as reception data, element signal extraction means for extracting data from the plurality of element signals output from the analog/digital conversion means at the same timing, and arithmetic processing means for detecting amplitudes and phases of the plurality of reception IF signals output from the frequency conversion means on the basis of the data extracted by the element signal extraction means.

In the phased-array antenna apparatus having the above arrangement, the RF pilot signals distributed by the frequency conversion means are respectively frequency-converted by the plurality of frequency conversion functions. The amplitudes and phases of the plurality of reception IF signals obtained by the plurality of frequency conversion functions are detected on the basis of the extracted data based on the conversion results.

According to the phased-array antenna apparatus having the above arrangement, therefore, the amplitudes and phases of a plurality of reception IF signals can be detected by using identical RF pilot signals within a short period of time.

In addition, in the present invention, the arithmetic processing means has a detection function of detecting amplitudes and phases of the reception IF signals output from the frequency conversion means on the basis of the data extracted by the element signal extraction means when the frequency conversion means frequency-converts the RF pilot signals, a calculation function of calculating variation amounts of amplitudes and phases of the reception IF signals by comparing the detection results obtained by the detection function with past detection results, and a function of calculating the weight data on the basis of the variation amounts obtained by the calculation function, and controlling weighting of the beam forming means.

According to this arrangement, for example, errors caused in reception signals by temperature changes and the like in frequency conversion performed by the frequency conversion means are detected as the above variation amounts. The variation amounts can be corrected by controlling weighing of the beam forming means.

In addition, in the present invention, the arithmetic processing means has a detection function of detecting amplitudes and phases of the reception IF signals output from the frequency conversion means on the basis of the data extracted by the element signal extraction means when the frequency conversion means frequency-converts the RF pilot signals, a calculation function of calculating variation amounts of amplitudes and phases of the reception IF signals by comparing the detection results obtained by the detection function with past detection results, and a function of detecting the frequency conversion function as a faulty function when the variation amounts obtained by the calculation function exceed predetermined values.

According to this arrangement, the amplitudes and phases of reception signals frequency-converted by all the frequency conversion functions are detected within a short period of time. The detection results are compared with the previous detection results obtained by using RF pilot signals to obtain variation amounts. When the variation amounts exceed predetermined values, the corresponding frequency conversion functions are detected as faulty functions. Therefore, fault diagnosis for the operation states of all the frequency conversion functions can be performed within a short period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
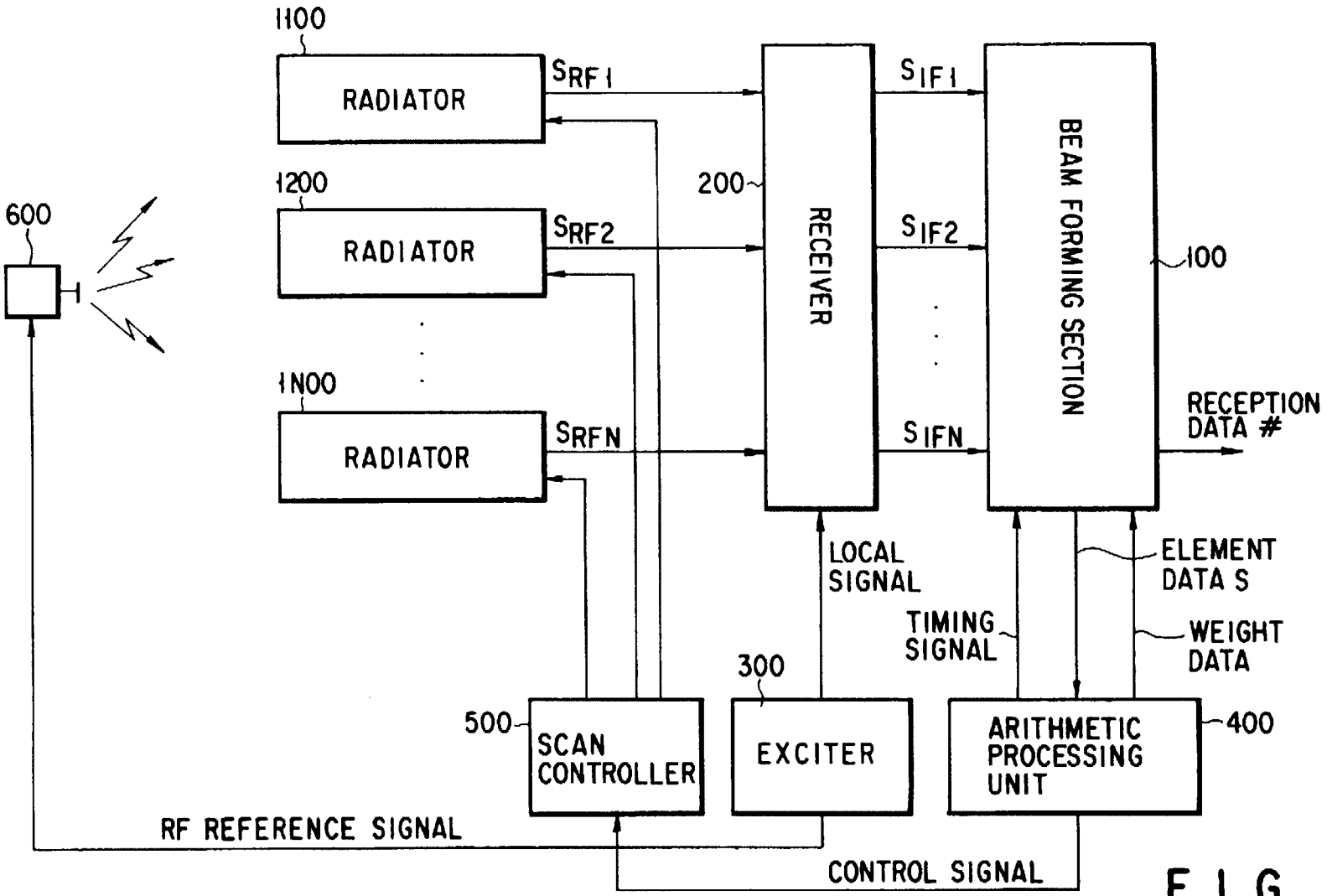
FIG. 1 is a block diagram showing the arrangement of a phased-array antenna apparatus according to an embodiment of the present invention.

A phased-array antenna apparatus according to an embodiment of the present invention will be described first with reference to FIG. 1. Note that FIG. 1 shows only the reception system.

Radar echoes from the object to be observed are received by radiators 1100 to 1N00. Each of these radiators 1100 to 1N00 includes M element antennas and M corresponding transmit/receive modules. The radiators 1100 to 1N00 control the amplitudes and phases of the received signals on the basis of control signals from a scan controller 500. The resultant signals are input as reception RF signals SRF1 to SRFN to a receiver 200.

The receiver 200 performs frequency conversion of the reception RF signals SRF1 to SRFN by using a local signal oscillated by an exciter 300, and inputs the conversion results as reception IF signals SIF1 to SIFN to a beam forming section 100.

The beam forming section 100 performs I/Q orthogonal detection with respect to the above reception IF signals, and extracts data from the detection results at the timing of a timing signal from an arithmetic processing unit 400. The beam forming section 100 then inputs the extracted data as N-channel element data S to the arithmetic processing unit 400, and performs weighted addition processing based on weight data from the arithmetic processing unit 400 with respect to the above detection results, thereby performing beam formation. The signals obtained by this beam formation are output as reception data #.

The arithmetic processing unit 400 inputs the above timing signal to the beam forming section 100 to obtain N-channel element data S from the beam forming section 100. The arithmetic processing unit 400 then detects the phase and amplitude data of the reception RF signals SRF1 to SRFN from the element data S, and compares the detected data with the initial (at the start of the operation) phase and amplitude data, thereby calculating the variation amounts (correction data) of phases and amplitudes. The arithmetic processing unit 400 outputs the above weight data and control signal corresponding to the correction data. This control signal is input to the scan controller 500.

The scan controller 500 controls the transmit/receive modules of the radiators 1100 to 1N00 on the basis of the above control signal. As described above, the exciter 300 oscillates a local signal and generates an RF reference signal by using the local signal when adjustment and fault diagnosis are to be performed for each transmit/receive module. This RF reference signal is input to a reference antenna 600 to be radiated in the air.

Figure 2:
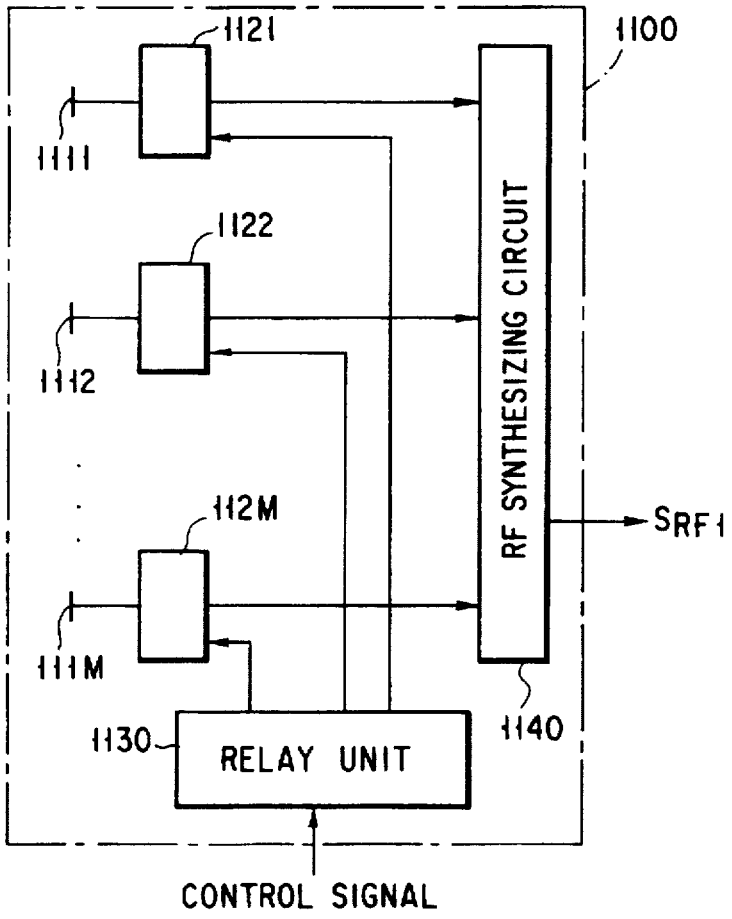
FIG. 2 is a block diagram showing the arrangement of a radiator of the phased-array antenna apparatus in FIG. 1.

The radiator 1100 will be described in detail next with reference to FIG. 2.

The radiator 1100 includes M element antennas 1111 to 111M, transmit/receive modules 1121 to 112M corresponding to the element antennas 1111 to 111M, an RF synthesizing circuit 1140, and a relay unit 1130.

The element antennas 1111 to 111M receive radar echoes from the object to be observed, and input the reception signals to the corresponding transmit/receive modules 1121 to 112M. The relay unit 1130 inputs control signals from the scan controller 500 to the transmit/receive modules 1121 to 112M.

The transmit/receive modules 1121 to 112M perform various signal control operations (to be described later) for the reception signals from the element antennas 1111 to 111M on the basis of the control signals from the relay unit 1130, and input the resultant signals to the RF synthesizing circuit 1140.

The RF synthesizing circuit 1140 synthesizes the output signals from the transmit/receive modules 1121 to 112M, and outputs the resultant signal as the above reception RF signal SRF1 to the receiver 200. Note that each of the radiators 1200 to 1N00 has the same arrangement as that of the radiator 1100, and hence a description thereof will be omitted.

Figure 3:
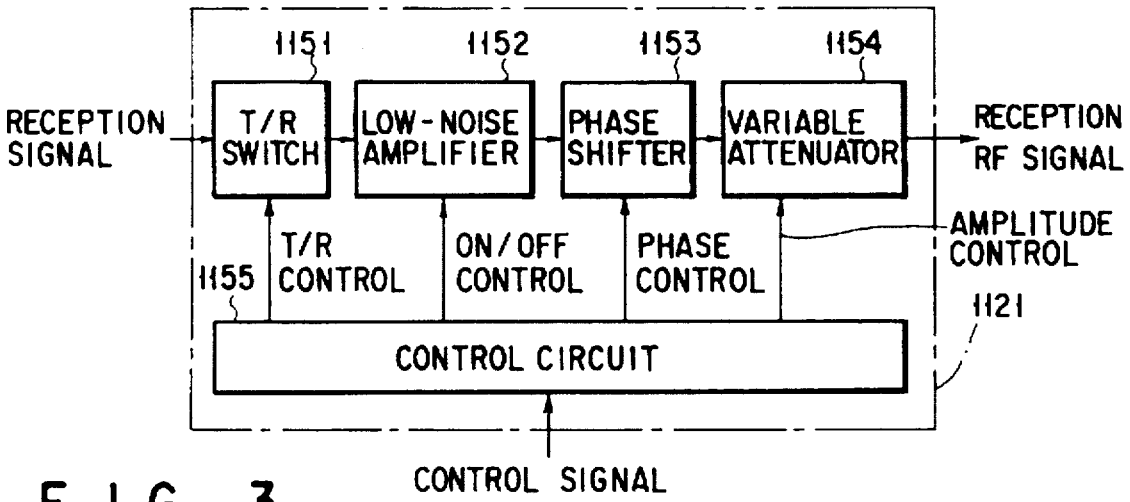
FIG. 3 is a block diagram showing the arrangement of a transmit/receive module of the radiator in FIG. 2.

The transmit/receive module 1121 will be described in detail next with reference to FIG. 3.

The transmit/receive module 1121 includes a T/R switch 1151, a low-noise amplifier 1152, a phase shifter 1153, a variable attenuator 1154, and a control circuit 1155 for controlling these components.

A reception signal from the element antenna 1111 is input to the low-noise amplifier 1152 through the T/R switch 1151 to be amplified. The phase of the amplified signal is controlled by the phase shifter 1153. The resultant signal has its amplitude controlled by the variable attenuator 1154 and input as a reception RF signal to the RF synthesizing circuit 1140.

The control circuit 1155 performs switching control of the T/R switch 1151 in accordance with transmit/receive on the basis of a control signal input from the scan controller 500 through the relay unit 1130. In addition, the control circuit 1155 performs ON/OFF control of the low-noise amplifier 1152, and controls the phase shift amount in the phase shifter 1153. The control circuit 1155 also performs amplitude control of the variable attenuator 1154 to control the amplitude of a signal supplied from the transmit/receive module 1121.

Note that each of the transmit/receive modules 1122 to 112M has the same arrangement as that of the transmit/receive module 1121, and hence a description thereof will be omitted.

Figure 4:
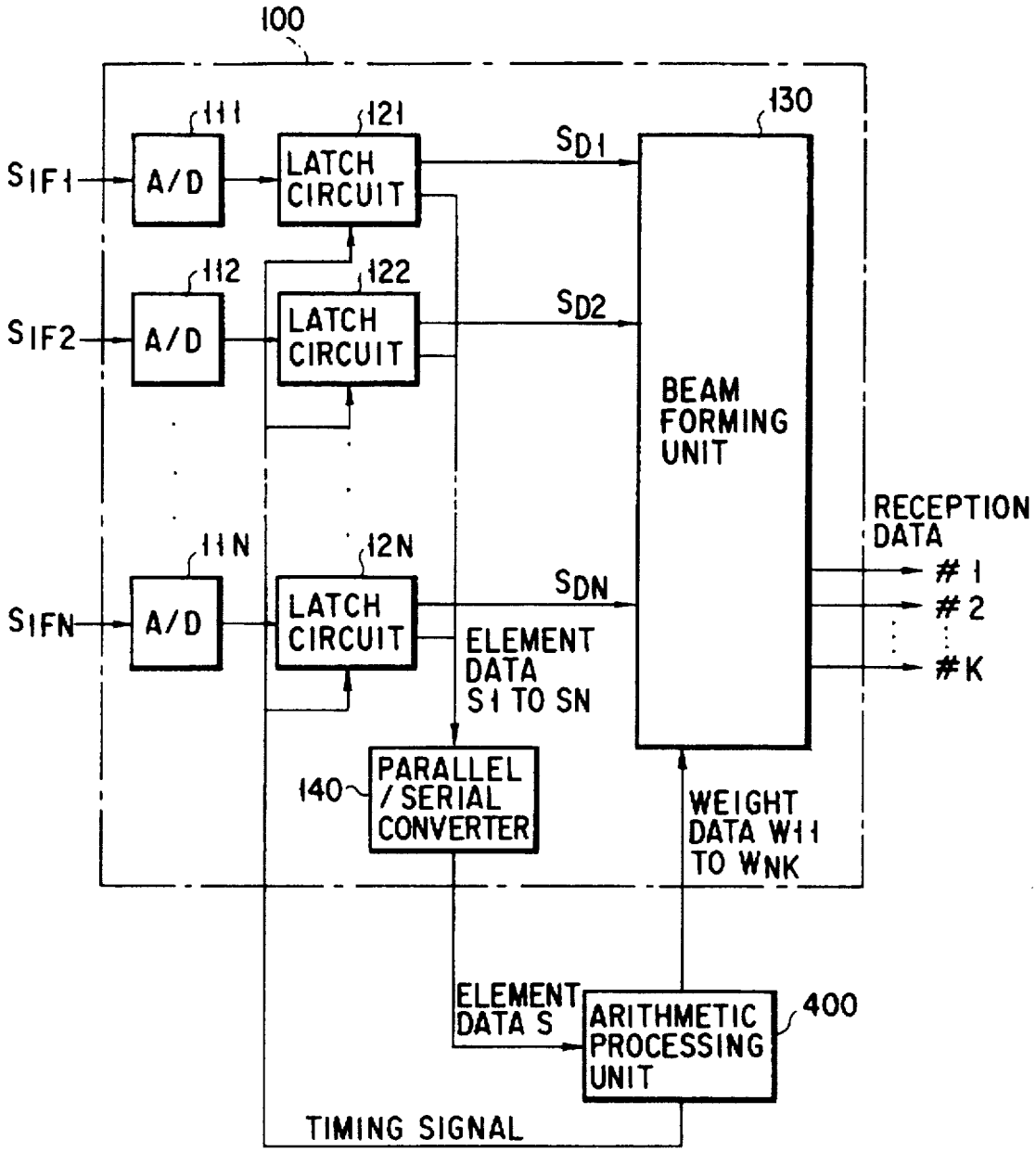
FIG. 4 is a block diagram showing the arrangement of a beam forming section of the phased-array antenna apparatus in FIG. 1.

The beam forming section 100 will be described in detail next with reference to FIG. 4.

The beam forming section 100 includes N A/D converters 111 to 11N, N latch circuits 121 to 12N corresponding to the converters, a beam forming unit 130, and a parallel/serial converter 140.

The reception IF signals SIF1 to SIFN are respectively input to the A/D converters 111 to 11N. The A/D converters 111 to 11N convert these signals into digital signals and form I/Q orthogonal signals. The A/D converters 111 to 11N then input these I/Q orthogonal signals to the corresponding latch circuits 121 to 12N.

The latch circuits 121 to 12N input the I/Q orthogonal signals detected by the A/D converters 111 to 11N, as digital reception signals SD1 to SDN, to the beam forming unit 130. In addition, the latch circuits 121 to 12N extract data from the I/Q orthogonal signals in synchronism with the timing of the above timing signal. As a result, N-channel parallel data S1 to SN are obtained and input to the parallel/serial converter 140.

The beam forming unit 130 receives weight data W11 to WNK from the arithmetic processing unit 400, and performs weighted addition processing based on the weight data W11 to SNK with respect to the digital reception signals SD1 to SDN. The beam forming unit 130 then outputs the processing results as reception data #1 to #K.

The parallel/serial converter 140 converts the N-channel parallel element data S1 to SN, synchronously extracted by the latch circuits 121 to 12N, into serial data, and inputs the conversion results as element data S to the arithmetic processing unit 400.

Figure 5:
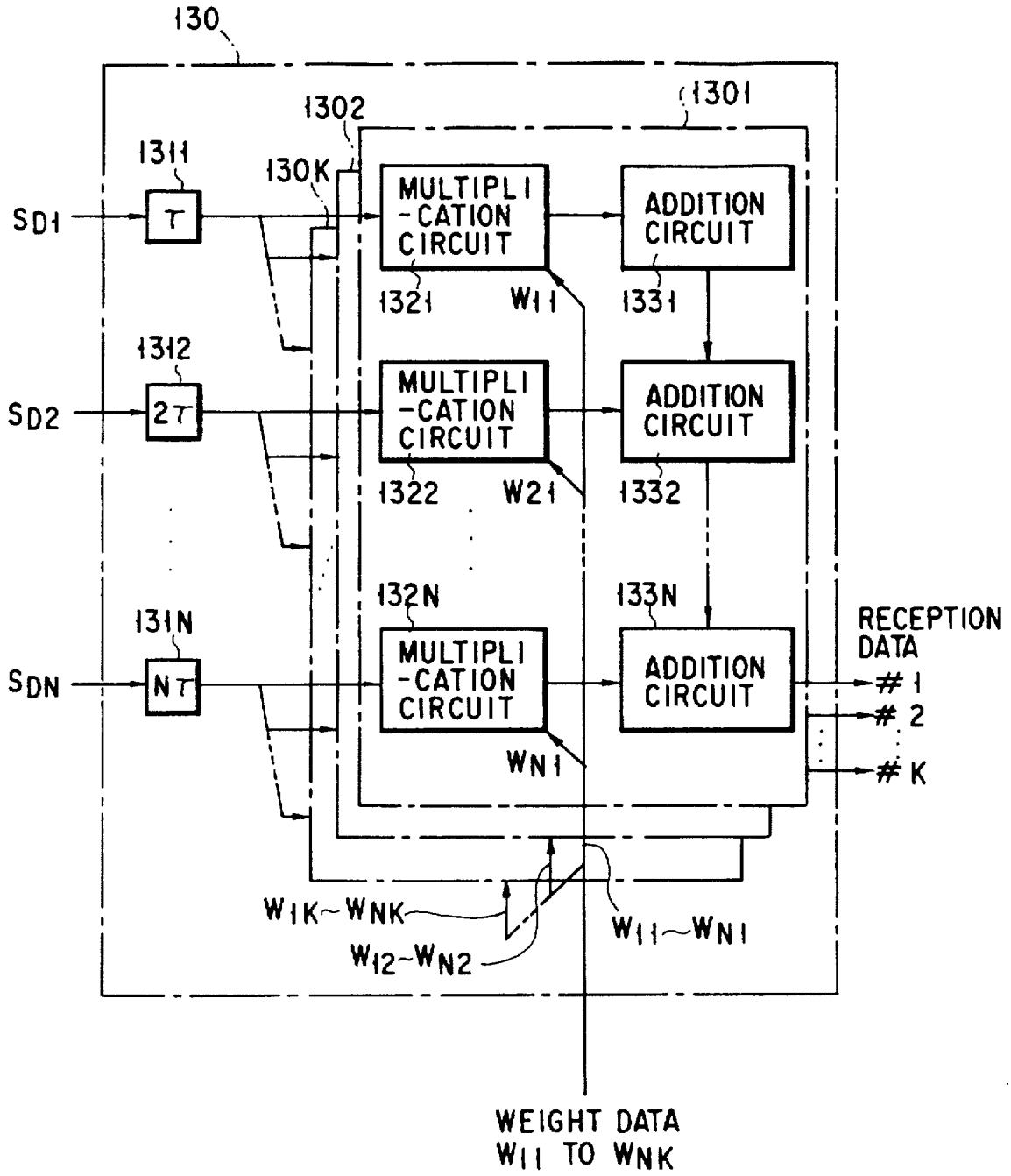
FIG. 5 is a block diagram showing the arrangement of the beam forming unit of the beam forming section in FIG. 4.

The beam forming unit 130 will be described in detail next with reference to FIG. 5.

The beam forming unit 130 includes N delay circuits 1311 to 131N and K beam forming units 1301 to 130K.

The delay circuits 1311 to 131N delay the digital reception signal SD1 to SDN by different delay times ($\tau$, $2\tau$, . . . , $N\tau$), respectively. The delay results obtained by the delay circuits 1311 to 131N are distributed into K routes and input to the beam forming units 1301 to 130K.

The beam forming circuit 1301 includes multiplication circuits 1321 to 132N and addition circuits 1331 to 133N. The multiplication circuits 1321 to 132N receive the outputs from the corresponding delay circuits 1311 to 131N and the above weight data W11 to WN1, and perform weighting based on complex multiplication with respect to the output from the delay circuits by using the weight data. The addition circuits 1331 to 133N sequentially add the products obtained by the multiplication circuits 1321 to 132N in a systolic manner in accordance with the above delay times, and output the resultant data as reception data #1.

Similar to the beam forming circuit 1301, beam forming circuits 1302 to 130K receive weight data $W_{12}$-$W_{N2}$ to $W_{1K}$-$W_{NK}$ corresponding to the delay results from the delay circuits 1311 to 131N, and obtain reception data #2 to #K.

The operation associated with the self-correction function of the phased-array antenna apparatus having the above arrangement will be described below.

An RF reference signal generated by the exciter 300 is radiated from the reference antenna 600 toward the radiators 1100 to 1N00. At this time, the radiators 1100 to 1N00 receive control signals from the arithmetic processing unit 400 through the scan controller 500.

In accordance with the above control signals, one of the M transmit/receive modules of each of the radiators 1100 to 1N00 is set in a receiving operation (ON) state. This operation is performed by ON/OFF-controlling the low-noise amplifier 1152 in FIG. 3. As a result, the RF reference signals received by a total of N transmit/receive modules are output as the reception RF signals SRF1 to SRFN.

The reception RF signals SRF1 to SRFN are frequency-converted by the receiver 200 and input as the reception IF signals SIF1 to SIFN to the A/D converters 111 to 1N of the beam forming section 100. The reception IF signals SIF1 to SIFN are converted into digital signals by the A/D converters 111 to 11N and output as I/Q orthogonal signals.

These orthogonal signals are input to the beam forming unit 130 through the latch circuits 121 to 12N, and synchronized by the latch circuits 121 to 12N to be output as the N-channel element data to SN. These element data S1 to SN are converted into serial element data S by the parallel/serial converter 140 and input to the arithmetic processing unit 400.

The arithmetic processing unit 400 detects the phase and amplitude data of the reception RF signals SRF1 to SRFN from the element data S, and compares the detected data with the initial phase and amplitude data measured in advance. With this comparison, the arithmetic processing unit 400 then calculates correction data for the above N transmit/receive modules.

Subsequently, the above correction data calculation operation is repeated a total of M times while transmit/receive modules to be set in the operation state are sequentially changed. With this processing, correction data for all (M×N) transmit/receive modules are calculated.

Upon calculating the correction data for all the transmit/receive modules, the arithmetic processing unit 400 inputs control signals based on the correction data to the respective transmit/receive modules through the scan controller 500 to perform correction (calibration) of the antenna wavefront.

The arithmetic processing unit 400 also outputs weight data W11 to WNK to the beam forming unit 130. The weight data S11 to WNK are obtained by multiplying complex weights generally used for beam formation by weights based on the above correction data, which are used for correction between channels. The beam forming circuits 1301 to 130K perform weighted addition processing by using the weight data W11 to WNK to perform beam formation.

According to the phased-array antenna apparatus having the above arrangement, when the apparatus has M×N transmit/receive modules, since N correction data required for calibration of transmit/receive modules can be calculated at once, correction data for all the transmit/receive modules can be obtained by only repeating this calculation for correction data M times. Therefore, all the transmit/receive modules can be calibrated to complete the correction of the antenna wavefront within a short period of time.

In general, an apparatus having element antennas 1111 to 111M and transmit/receive modules 1121 to 112M, like the phased-array antenna apparatus having the above arrangement, is required to have a function of sensing the faulty states (e.g., fault positions and the number of faults) of these components.

According to the phased-array antenna apparatus having the above arrangement, the phase and amplitude data of reception signals output from the transmit/receive modules 1121 to 112M can be compared with the initial phase and amplitude data within a short period of time. For this reason, detection of abnormalities, e.g., a decrease in the gain of an amplifier and a control failure in the phase shifter, can be performed within a short period of time. In addition, fault positions and the number of faults can be accurately detected.

In the phased-array antenna apparatus having the above arrangement, the above weight data W11 to WNK are set by multiplying the complex weights generally used for beam formation by the weights based on the above correction data, which are used for correction between channels. For this reason, the amplitudes and phases of reception signals are controlled for each of the radiators 1100 to 1N00.

In the above embodiment, beam formation and correction between channels are simultaneously performed by the beam forming unit 130 by using the weight data W11 to WNK obtained by multiplying the complex weights generally used for beam formation and the weights for correction between channels. However, the present invention is not limited to this. For example, a beam forming unit 131 shown in FIG. 6 may be used in place of the beam forming unit 130.

In the beam forming unit 131, digital reception signals SD1 to SDN delayed by delay circuits 1311 to 131N are subjected to weighting for correction between channel in multiplication circuits 1341 to 134N. The weighting results are distributed into K routes and input to the beam forming circuits 1301 to 130K.

In the beam forming circuits 1301 to 130K, general weighting for beam formation is performed by multiplication circuits 1321 to 132N, and the resultant data are sequentially added in a systolic manner by addition circuits 1331 to 133N, thereby forming desired beams.

As is apparent, the same effects as those described can be obtained even if weighting for correction between channels and weighting for beam formation are independently performed to simplify the arithmetic processing for beam formation.

Figure 7:
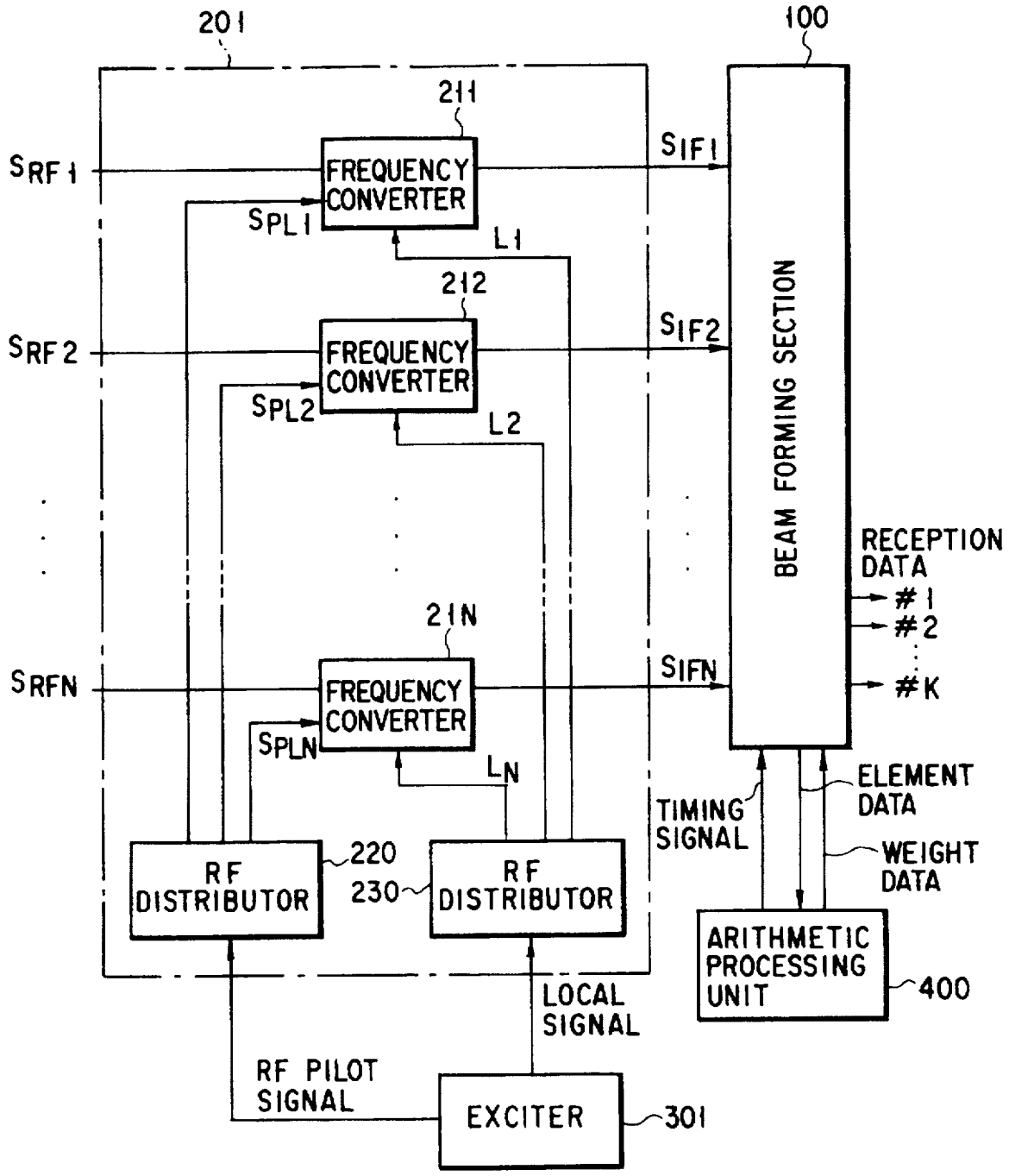
FIG. 7 is a block diagram showing the arrangement of the receiver of the phased-array antenna apparatus in FIG. 1.

The receiver 200 and the exciter 300 are not limited to the above arrangements. For example, a receiver 201 and an exciter 301 shown in FIG. 7 may be used. A case wherein the receiver 201 and the exciter 301 are used in place of the receiver 200 and the exciter 300 will be described below.

The receiver 201 includes frequency converters 211 to 21N and RF distributors 220 and 230. The exciter 301 oscillates a local signal and inputs it to the RF distributor 230. The exciter 301 also generates an RF pilot signal by using the above local signal and inputs it to the RF distributor 220.

The RF distributor 220 distributes the RF pilot signal into N routes. The distributed signals are respectively input as RF pilot signals SPL1 to SPLN to the frequency converters 211 to 21N. Similarly, the RF distributor 230 distributes the local signal into N routes. The distributed signals are respectively input as local signals L1 to LN to the frequency converters 211 to 21N.

Reception RF signals SRF1 to SRFN and the above RF pilot signals SPL1 to SPLN are respectively input to the frequency converters 211 to 21N. One of the two signals input to each frequency converter is selectively frequency-converted by using a corresponding one of the local signals L1 to LN. The resultant signals are input as reception IF signals IF1 to IFN1 to the beam forming section 100.

Figure 8:
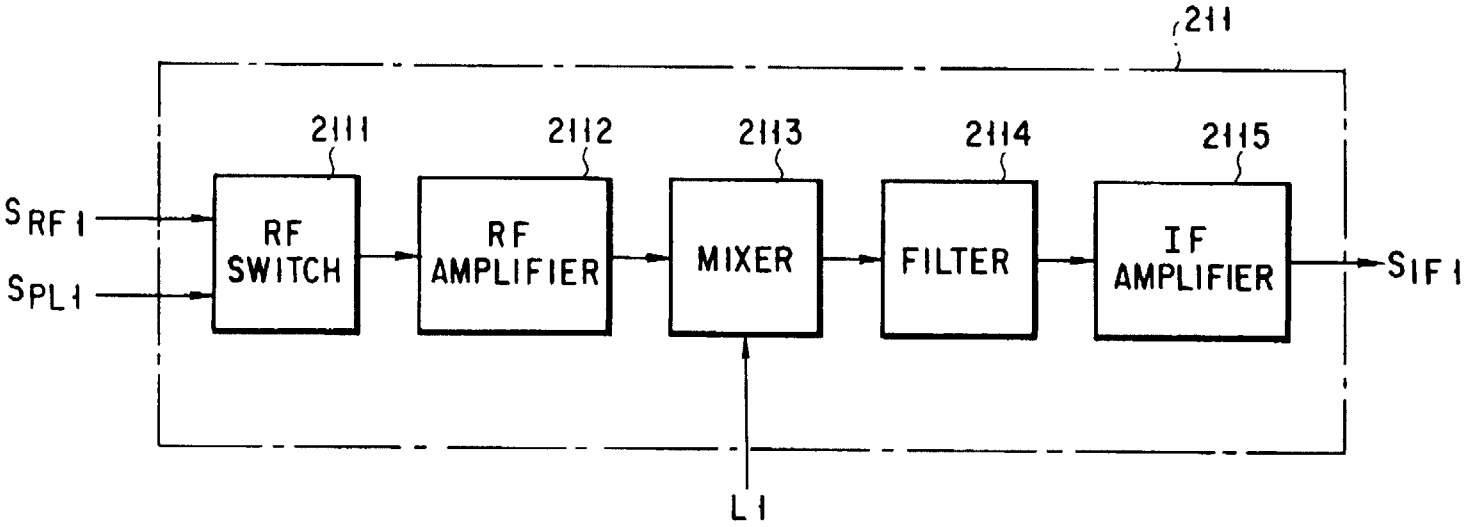
FIG. 8 is a block diagram showing the arrangement of a frequency converter of the receiver in FIG. 7.

The detailed arrangement of the frequency converter 211 will be described next with reference to FIG. 8. The frequency converter 211 includes an RF switch 2111, an RF amplifier 2112, a mixer 2113, a filter 2114, and an IF amplifier 2115.

The RF switch 2111 receives the reception RF signal SRF1 and the RF pilot signal SPL1, and selectively inputs one of the signals to the RF amplifier 2112. The RF amplifier 2112 amplifies the signal from the RF switch 2111 and inputs the resultant signal to the mixer 2113.

The mixer 2113 frequency-converts the output signal from the RF amplifier 2112 by using the local signal L1. The resultant signal is input to the IF amplifier 2115 through the filter 2114. The IF amplifier 2115 performs IF amplification of the output signal from the filter 2114. The resultant signal is input as the reception IF signal SIF1 to the beam forming section 100.

Similar to the frequency converter 211, the frequency converters 212 to 21N respectively frequency-convert the input signals into the reception IF signals SIF2 to SIFN. Note that these frequency converters have the same arrangement as that of the frequency converter 211, and hence a detailed description thereof will be omitted.

According to the above arrangement, in a normal receiving operation, the RF switches 2111 of the frequency converters 212 to 21N select the reception RF signals SRF1 to SRFN, and perform signal processing in the same manner as described above, thereby obtaining reception data.

In performing adjustment and fault diagnosis, the RF switches 2111 of the frequency converters 212 to 21N select the RF pilot signals SPL1 to SPLN. With this operation, the RF pilot signals SPL1 to SPLN are frequency-converted by the frequency converters 212 to 21N and input to the beam forming section 100.

In the beam forming section 100, the N-channel element data S1 to SN obtained in the same manner as in the above embodiment are input to the arithmetic processing unit 400. The arithmetic processing unit 400 detects the phase and amplitude data of the reception RF signals SRF1 to SRFN from the element data S.

The detection results are then compared with the phase and amplitude data measured in advance by using the pilot signals SPL1 to SPLN. The variation amounts (correction data) of phases and amplitudes are calculated, and the above weight data based on the correction data are output to the beam forming section 100.

In the beam forming section 100, as described above, the beam forming circuits 1301 to 130K perform weighted addition processing by using the above weight data to perform beam formation. Note that the above weight data are obtained by multiplying the complex weights generally used for beam formation and the weights based on the above correction data, which are used for correction between channels.

According to the above arrangement, variation components (amplitude and phase errors) produced in the receiver 201 and the elements following the receiver 201 can be periodically detected by the arithmetic processing unit 400 using the same RF pilot signals SPL1 to SPLN. In addition, the above detection can be performed for all the reception IF signal altogether.

Amplitude and phase errors caused between the respective channels owing to the influences of temperature changes and the like in the receiver 201 and the elements following the receiver 201 can therefore be detected within a short period of time, and correction for the errors and repairs to faults can be performed.

Figure 6:
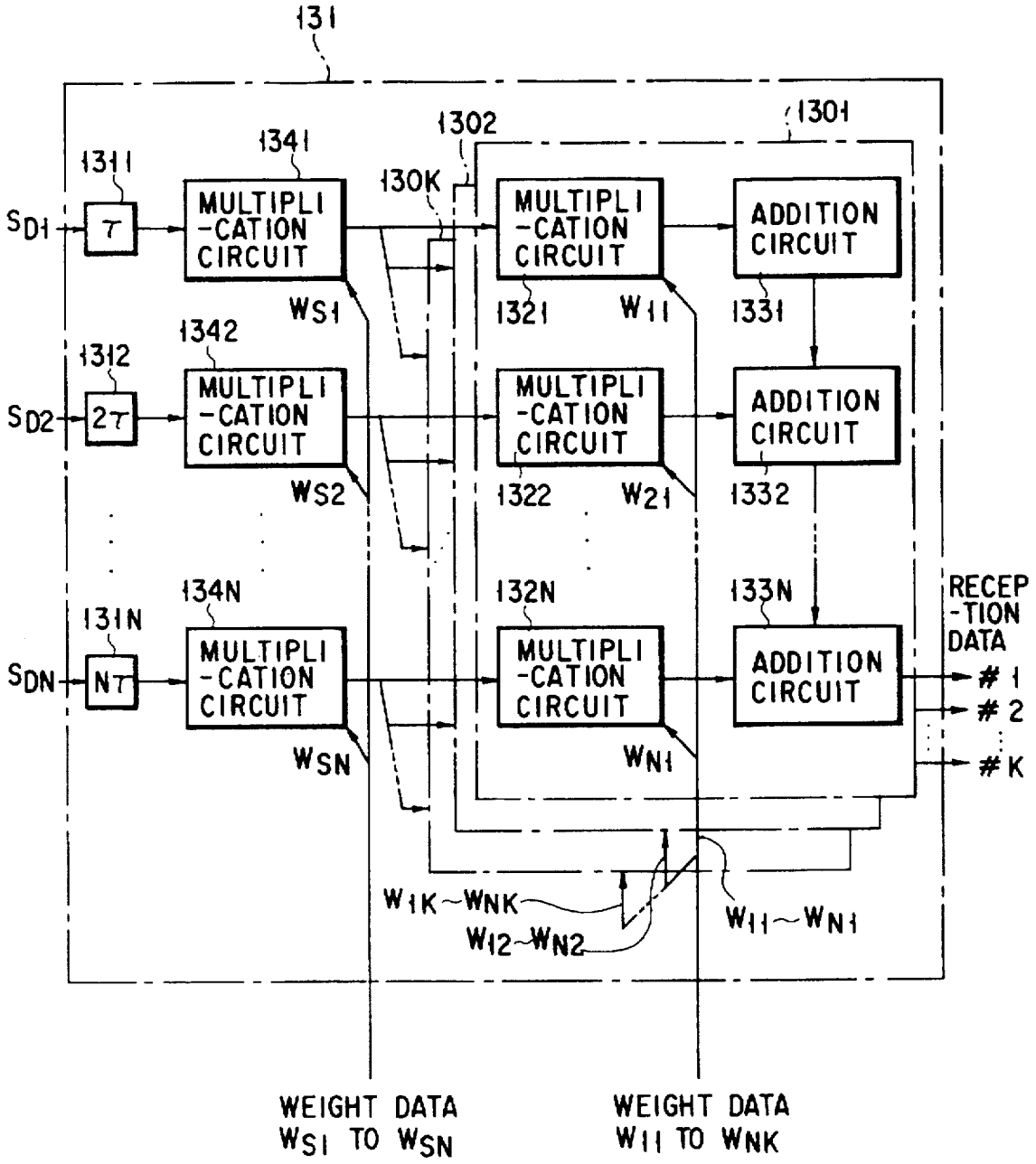
FIG. 6 is a block diagram showing the arrangement of another beam forming unit of the beam forming section in FIG. 4.

Similar to the above embodiment, desired beams may be formed by correcting the amplitude and phase errors between the respective channels using the beam forming unit 131 shown in FIG. 6 in place of the beam forming unit 130. As is apparent, with such an operation, the same effects as those described above can be obtained.

In the array antenna apparatus in which the element antennas 1111 to 111M of the radiators 1100 to 1N00 are two-dimensionally arranged in an array, phase and amplitude variations are caused electrically or mechanically by heat, pressure, and the like produced inside or outside the antennas.

If a cooling device for cooling the transmit/receive modules is used against such heat, temperature distribution differences are produced depending on the cooling ability of the device, or temperature differences and variations are caused when the apparatus is locally heated by an external heat source. With regard to pressure, the antenna aperture is distorted by wind pressure or vibrations, resulting in variations.

Such variations caused by heat or pressure change continuously and smoothly over time. For this reason, amplitude and phase errors in output signals from a plurality of element antennas arranged in an array vary over time.

The present invention is also effective for such amplitude and phase errors between the element antennas which vary over time. An apparatus for this purpose will be described below with reference to FIG. 9. The same reference numerals in FIG. 9 denote the same parts as described above, and a detailed description thereof will be omitted.

Figure 9:
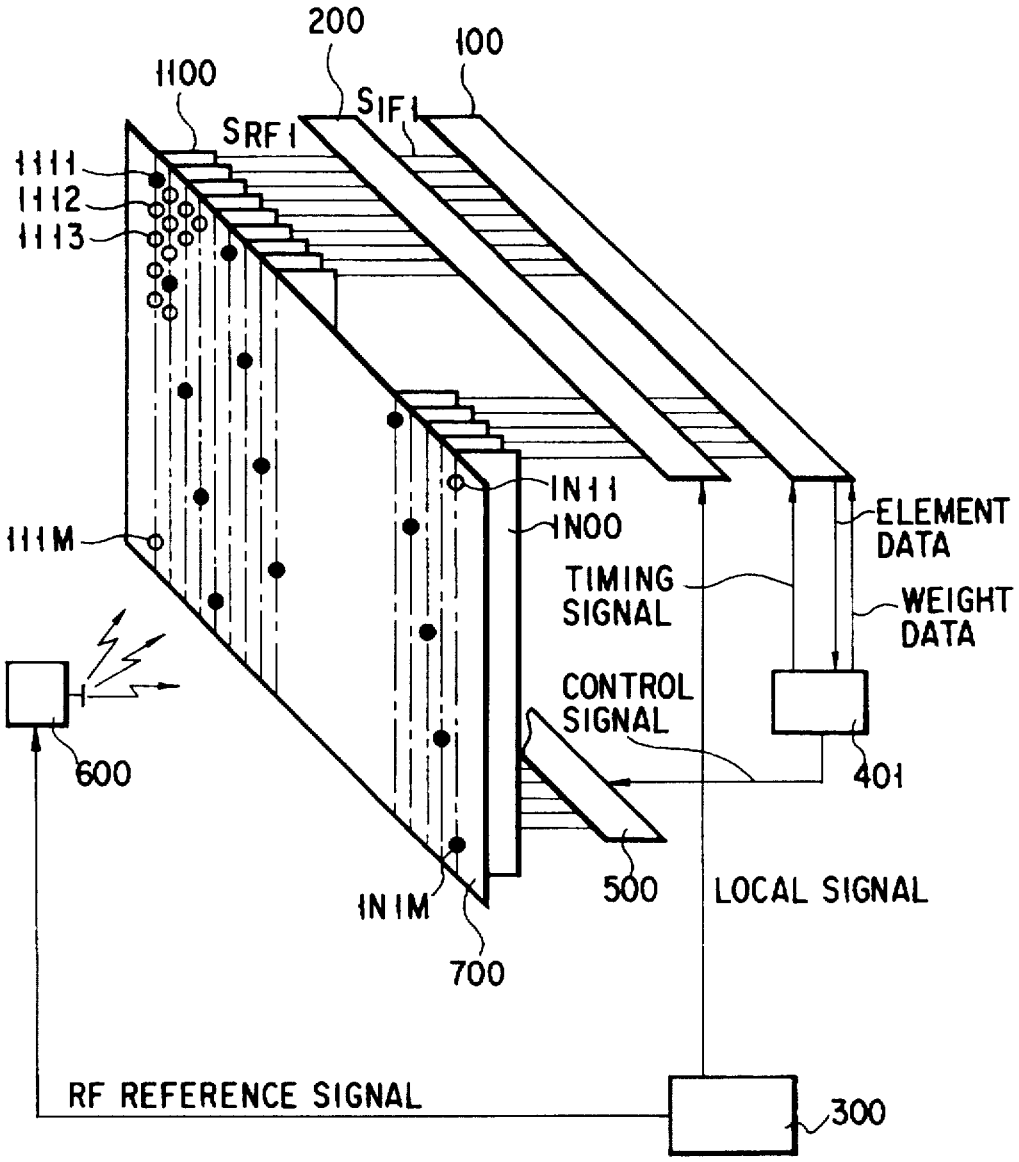
FIG. 9 is a view showing the arrangement of the phased-array antenna apparatus in FIG. 1 with the element antennas being two-dimensionally arranged in an array.

The basic arrangement of the antenna apparatus shown in FIG. 9 is the same as that of the antenna apparatus shown in FIG. 1, but is especially characterized in that element antennas 1111 to 111M of radiators 1100 to 1N00 are two-dimensionally arranged in an array to form an antenna aperture 700.

This antenna apparatus performs a beam scanning operation by a one-dimensional DBF (Digital Beam Forming) scheme (vertical RF synthesizing scheme; horizontal DBF scheme) using the antenna aperture 700 having M (vertical) ×N (horizontal) element antennas arranged in a two-dimensional array. The self-correcting operation in the above arrangement will be described below.

An RF reference signal is radiated from an exciter 300 toward the antenna aperture 700 through a reference antenna 600. Meanwhile, the radiators 1100 to 1N00 receive control signals from an arithmetic processing unit 401 through a scan controller 500. In accordance with the control signals, one (to be referred to as an operating element) of the transmit/receive modules of each of the radiators 1100 to 1N00 is set in a receiving operation (ON) state.

Figure 10:
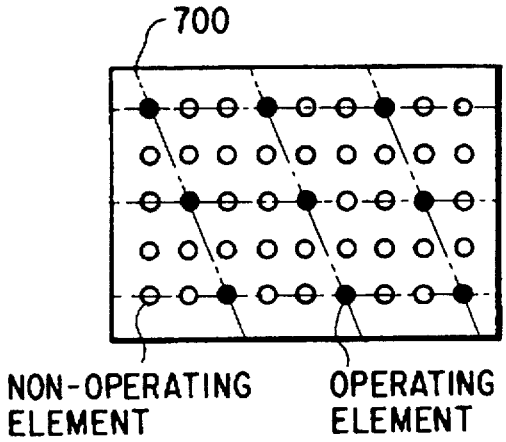
FIG. 10 is a view showing an array of operating elements of the elements arrayed on the antenna aperture in FIG. 9.

These operating elements are selected to form a discrete array on the antenna aperture 700. For example, as shown in FIG. 10, the operating elements are selected to form a mesh-like pattern on the antenna aperture 700. Referring to FIG. 10, five element antennas (M (vertical)) and nine element antennas (N (horizontal)) are arranged in a two-dimensional array. Each column of element antennas includes one operating element.

The RF reference signals received by the operating elements are output as reception RF signals SRF1 to SRFN. As described above, these reception RF signals SRF1 to SRFN are frequency-converted into reception IF signals SIF1 to SIFN by a receiver 200, and input to a beam forming section 100.

The reception IF signals SIF1 to SIFN are converted into digital signals by the beam forming section 100 and formed into I/Q orthogonal signals. Data are extracted from these I/Q orthogonal signals at the timing of a timing signal from an arithmetic processing unit 401 and transferred as N-channel element data S to the arithmetic processing unit 401.

The arithmetic processing unit 401 detects the phase and amplitude data of the reception RF signals SRF1 to SRFN from the element data S. The arithmetic processing unit 401 compares the detected phase and amplitude data with the phase and amplitude data of the operating elements which are detected in advance, and calculates the variation amounts of phases and amplitudes. The arithmetic processing unit 401 then calculates correction data corresponding to the operating elements on the basis of these variation amounts.

With respect to the remaining transmit/receive modules which have not been in the receiving operation state (to be referred to as non-operating elements hereinafter), the estimated values of correction data are calculated on the basis of the positional correlations between the non-operating and operating elements and the above variation amounts.

Figure 11:
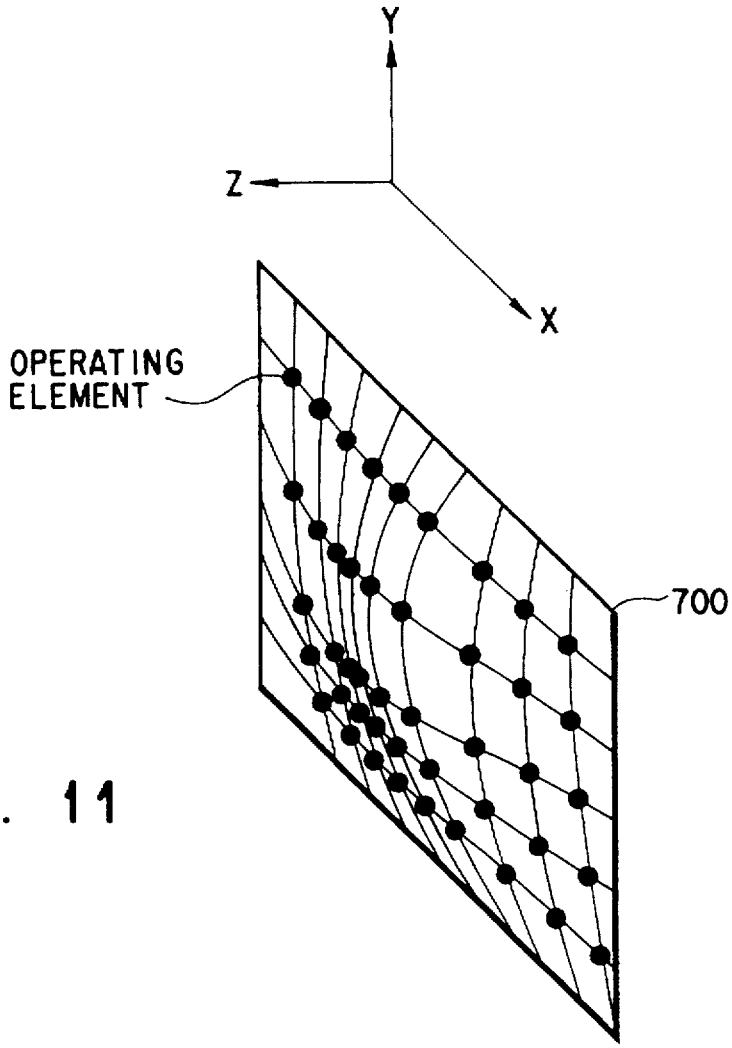
FIG. 11 is a view showing continuous changes in the variation amount of phase or amplitude on the antenna aperture in FIG. 9.
Figure 12:
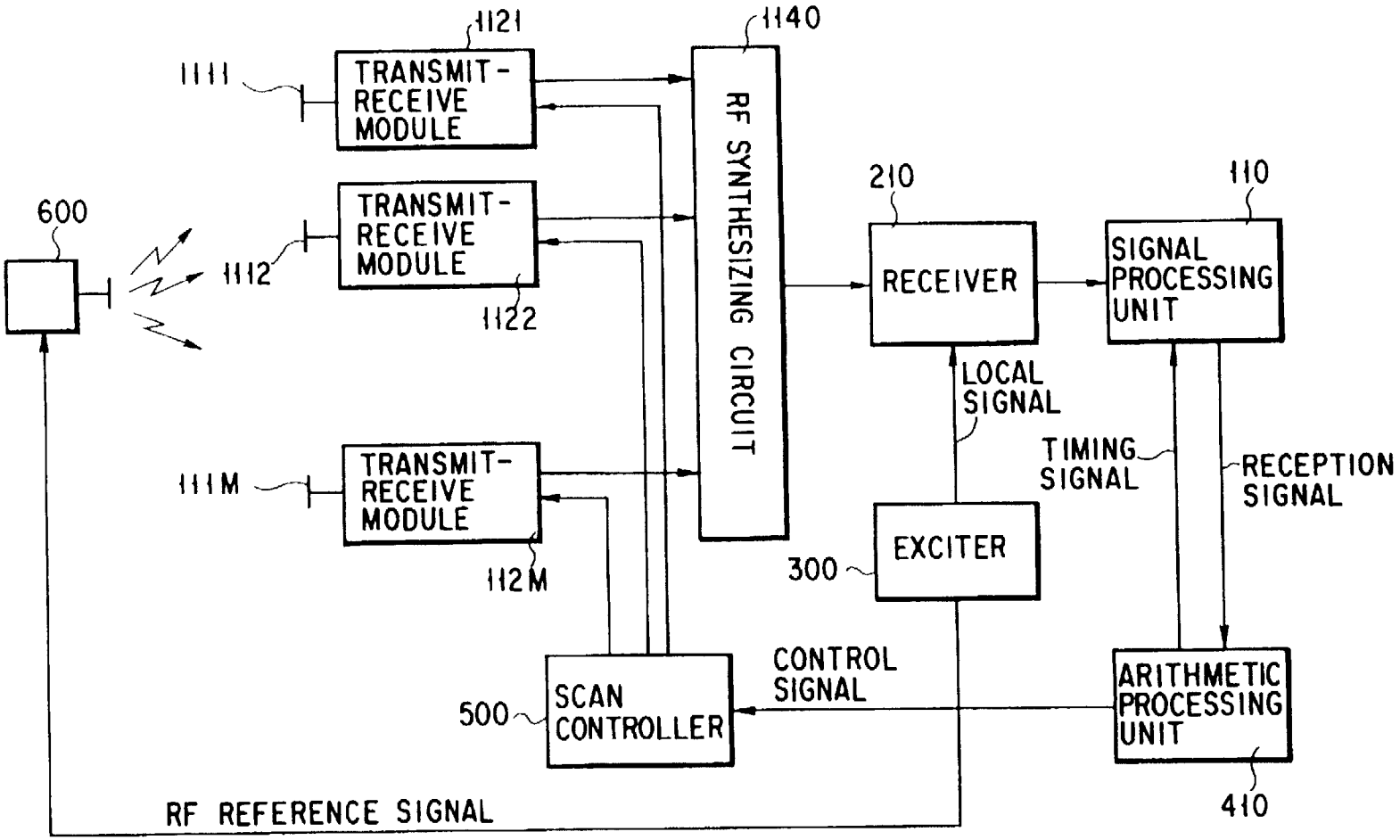
FIG. 12 PRIOR ART
FIG. 12 is a block diagram showing the arrangement of a conventional phased-array antenna apparatus.

Subsequently, correction (calibration) for all the transmit/receive modules is performed on the basis of the above correction data (estimated values). Note that the estimated values of the correction data for the non-operating elements can be obtained by, e.g., spline interpolation processing. FIG. 11 shows the state of this processing.

Referring to FIG. 11, the X- and Y-axes indicate the coordinates of the elements on the antenna aperture, and the Z-axis indicates the variation amounts of phase or amplitude relative to the initial state. As described above, N variation amounts like those described above are obtained by discretely selecting transmit/receive modules and setting them in the receiving operation state in the above manner.

Subsequently, spline interpolation processing based on these N variation amounts is performed to estimate the variation amounts of the non-operating elements. The estimated values of the correction data for the non-operating elements are calculated on the basis of the variation amounts obtained in this manner.

As described above, in the antenna apparatus having the above arrangement, the N transmit/receive modules are discretely selected and set in the receiving operation state, and variation amounts are calculated from the past phase and amplitude data of these operating elements. Thereafter, correction data for all the transmit/receive modules are calculated on the basis of these variation amounts, and correction is performed.

Since correction for all transmit/receive modules 1121 to 112M can be performed by only measuring the variation amounts associated with the N transmit/receive modules, correction for the antenna wavefront can be completed within a shorter period of time than in the above embodiment. This apparatus can therefore follow variations in amplitude and phase errors over time.

In this embodiment, the antenna aperture is regarded as a two-dimensional flat plane. However, the antenna aperture may take an arbitrary three-dimensional shape as long as the coordinates of each element are specified.

In addition, similar to the above embodiment, desired beams may be formed by correcting the amplitude and phase errors between the respective channels using the beam forming unit 131 shown in FIG. 6 in place of the beam forming unit 130. As is apparent, with such an operation, the same effects as those described above can be obtained.

In each embodiment described above, the reference antenna 600 opposes the antenna aperture. However, a reference antenna or antennas may be installed at a portion or portions of the antenna aperture. Alternatively, a given element antenna may be used as a reference antenna.

The above description is associated with the active phased-array antenna apparatuses, in particular. However, even in a passive phased-array antenna apparatus using a phase shifter having no amplifier or the like, fault diagnosis in the transmit/receive modules, phase correction, beam formation, and correction between channels can be performed.

Furthermore, in each radiator described above, a plurality (M) of element antennas and transmit/receive modules are arranged. However, such elements need not always be plural, and the present invention can also applied to an arrangement with M=1.

As is apparent, various changes and modifications of the above embodiments can be made without departing from the spirit and scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A phased-array antenna apparatus comprising:

a plurality of radiators each including a plurality of element antennas arranged in an array, a plurality of transmit/receive modules for transmitting/receiving RF signals to/from said corresponding element antennas and controlling phases and amplitudes of the RF signals on the basis of a control signal, and an RF synthesizing circuit for synthesizing reception signals output from said plurality of transmit/receive modules, and outputting the resultant signal as an RF synthetic signal;

scan control means for generating a control signal for controlling phases and amplitudes of said plurality of transmit/receive modules for each of said plurality of radiators;

frequency conversion means for separately frequency-converting the RF synthetic signals output from said plurality of radiators, and outputting the resultant signals as reception IF signals;

analog/digital conversion means for separately converting the plurality of reception IF signals output from said frequency conversion means into digital signals, and outputting the signals as element signals;

beam forming means for performing beam formation by separately weighting the plurality of element signals output from said analog/digital conversion means in accordance with external weight data and adding the signals, and outputting the addition results as reception data;

element signal extraction means for extracting data from the plurality of element signals output from said analog/digital conversion means at the same timing; and arithmetic processing means for detecting amplitudes and phases of the RF synthetic signals, output from said plurality of radiators, from the data extracted by said element signal extraction means.

2. A phased-array antenna apparatus comprising:

a plurality of radiators each including a plurality of element antennas arranged in an array, a plurality of transmit/receive modules for transmitting/receiving RF signals to/from said corresponding element antennas and controlling phases of the RF signals on the basis of a control signal, and an RF synthesizing circuit for synthesizing reception signals output from said plurality of transmit/receive modules, and outputting the resultant signal as an RF synthetic signal;

scan control means for generating a control signal for controlling phases of said plurality of transmit/receive modules for each of said plurality of radiators;

frequency conversion means for separately frequency-converting the RF synthetic signals output from said plurality of radiators, and outputting the resultant signals as reception IF signals;

analog/digital conversion means for separately converting the plurality of reception IF signals output from said frequency conversion means into digital signals, and outputting the signals as element signals;

beam forming means for performing beam formation by separately weighting the plurality of element signals output from said analog/digital conversion means in accordance with external weight data and adding the signals, and outputting the addition results as reception data;

element signal extraction means for extracting data from the plurality of element signals output from said analog/digital conversion means at the same timing; and arithmetic processing means for detecting amplitudes and phases of the RF synthetic signals, output from said plurality of radiators, from the data extracted by said element signal extraction means.

3. An apparatus according to claim 1, further comprising:

oscillation means for generating a local signal used for frequency conversion in said frequency conversion means and an RF reference signal based on the local signal; and a reference antenna for transmitting the RF reference signal to said radiators.

4. An apparatus according to claim 1, wherein said arithmetic processing means has a function of sequentially performing control, with respect to all said transmit/receive modules, to operate only some of said transmit/receive modules of said plurality of radiators.

5. An apparatus according to claim 4, wherein said arithmetic processing means has a detection function of detecting amplitudes and phases of reception signals output from the operated transmit/receive modules on the basis of the data extracted by said element signal extraction means, a calculation function of calculating variation amounts of amplitudes and phases of the reception signals by comparing the detection results obtained by the detection function with past detection results associated with the operated transmit/receive modules, and a function of controlling phase shift amounts and gains of the corresponding transmit/receive modules through said scan control means on the basis of the variation amounts obtained by the calculation function.

6. An apparatus according to claim 4, wherein said arithmetic processing means has a detection function of detecting amplitudes and phases of reception signals output from the operated transmit/receive modules on the basis of the data extracted by said element signal extraction means, a calculation function of calculating variation amounts of amplitudes and phases of the reception signals by comparing the detection results obtained by the detection function with past detection results associated with the operated transmit/ receive modules, and a function of calculating the weight data on the basis of the variation amounts obtained by the calculation function, and controlling weighting of said beam forming means.

7. An apparatus according to claim 4, wherein said arithmetic processing means has a detection function of detecting amplitudes and phases of reception signals output from said operated transmit/receive modules on the basis of the data extracted by said element signal extraction means, a calculation function of calculating variation amounts of amplitudes and phases of the reception signals by comparing the detection results obtained by the detection function with past detection results associated with the operated transmit/receive modules, and a function of detecting said transmit/receive modules as faulty elements when the variation amounts obtained by the calculation function exceed predetermined values.

8. An apparatus according to claim 1, wherein said arithmetic processing means has a function of operating some of said plurality of transmit/receive modules through said scan control means, a detection function of detecting amplitudes and phases of reception signals output from the operated transmit/receive modules from the data extracted by said element signal extraction means, a calculation function of calculating variation amounts of amplitudes and phases of the reception signals by comparing the detection results obtained by the detection function with past detection results associated with the operated transmit/receive modules, and a function of calculating a distribution state of continuous variation amounts on an antenna aperture formed by said plurality of element antennas, arranged in an array, on the basis of the variation amounts obtained by the calculation function.

9. An apparatus according to claim 8, wherein said arithmetic processing means has a function of controlling phase shift amounts and gains of said transmit/receive modules through said scan control means on the basis of the calculation results obtained by the calculation function of calculating the distribution state of continuous variation amounts on the antenna aperture.

10. An apparatus according to claim 8, wherein said arithmetic processing means has a function of calculating the weight data based on the calculation results obtained by the calculation function of calculating the distribution state of continuous variation amounts on the antenna aperture, and controlling weighting of said beam forming means.

11. An apparatus according to claim 6 or 10, wherein said beam forming means separately performs weighting of a plurality of element signals output from said analog/digital conversion means by using weight data from said arithmetic processing means to perform correction, then separately performs weighting for beam formation with respect to the signals, adds the signals, and outputs the resultant data as reception data.

12. A phased-array antenna apparatus comprising:

transmit/receive means for controlling phases and amplitudes of a plurality of signals, and transmitting/receiving the controlled signals;

oscillation means for generating a local signal and an RF pilot signal based on the local signal;

frequency conversion means having a distribution function of distributing the RF pilot signal into a plurality of routes, a selection function of selecting the plurality of RF pilot signals distributed by the distribution function or a plurality of signals received by said transmit/receive means, and a plurality of frequency conversion functions of frequency-converting the plurality of signals selected by the selection function by using the local signal, and outputting the resultant signals as reception IF signals;

analog/digital conversion means for separately converting the plurality of reception IF signals output from said frequency conversion means into digital signals, and outputting the digital signals as element signals;

beam forming means for separately performing weighting of the plurality of element signals output from said analog/digital conversion means in accordance with external weight data, then adding the signals to perform beam formation, and outputting the resultant data as reception data;

element signal extraction means for extracting data from the plurality of element signals output from said analog/digital conversion means at the same timing; and arithmetic processing means for detecting amplitudes and phases of the plurality of reception IF signals output from said frequency conversion means on the basis of the data extracted by said element signal extraction means.

13. An apparatus according to claim 12, wherein said transmit/receive means comprises:

a plurality of radiators including at least element antennas and transmit/receive modules for transmitting/receiving RF signals to/from said element antennas and controlling phases and amplitudes of the RF signals on the basis of a control signal; and scan control means for generating a control signal for controlling phases and amplitudes in the plurality of transmit/receive modules for each of said plurality of radiators.

14. An apparatus according to claim 12, wherein said arithmetic processing means has a detection function of detecting amplitudes and phases of the reception IF signals output from said frequency conversion means on the basis of the data extracted by said element signal extraction means when said frequency conversion means frequency-converts the RF pilot signals, a calculation function of calculating variation amounts of amplitudes and phases of the reception IF signals by comparing the detection results obtained by the detection function with past detection results, and a function of calculating the weight data on the basis of the variation amounts obtained by the calculation function, and controlling weighting of said beam forming means.

15. An apparatus according to claim 12, wherein said arithmetic processing means has a detection function of detecting amplitudes and phases of the reception IF signals output from said frequency conversion means on the basis of the data extracted by said element signal extraction means when said frequency conversion means frequency-converts the RF pilot signals, a calculation function of calculating variation amounts of amplitudes and phases of the reception IF signals by comparing the detection results obtained by the detection function with past detection results, and a function of detecting the frequency conversion function as a faulty function when the variation amounts obtained by the calculation function exceed predetermined values.

16. An apparatus according to claim 14, wherein said beam forming means separately performs weighting of the plurality of element signals output from said analog/digital conversion means by using the weight data from said arithmetic processing means, separately performs weighting for beam formation with respect to the signals, adds the signals, and outputs the resultant data as reception data.

* * * * *